US008490238B2

(12) United States Patent
Sohn

(10) Patent No.: US 8,490,238 B2
(45) Date of Patent: Jul. 23, 2013

(54) TOWEL

(76) Inventor: Dae Up Sohn, Seoul (KR)

( * ) Notice: Subject to any disclaimer, the term of this patent is extended or adjusted under 35 U.S.C. 154(b) by 1211 days.

(21) Appl. No.: 12/362,582

(22) Filed: Jan. 30, 2009

(65) Prior Publication Data

US 2009/0172905 A1 Jul. 9, 2009

Related U.S. Application Data

(63) Continuation-in-part of application No. PCT/KR2007/003804, filed on Aug. 8, 2007.

(30) Foreign Application Priority Data

Aug. 8, 2006 (KR) ..... 10-2006-0074461

(51) Int. Cl.
*A47K 10/02* (2006.01)

(52) U.S. Cl.
USPC ..... 15/209.1

(58) Field of Classification Search
USPC ..... 15/208, 209.1, 210.1, 214, 227; 383/4, 383/6, 100
See application file for complete search history.

(56) References Cited

U.S. PATENT DOCUMENTS

| | | | | |
|---|---|---|---|---|
| 2,233,157 | A | 4/1939 | Cahn et al. | |
| 2,204,947 | A * | 6/1940 | Apfelbaum | 15/208 |
| 2,803,845 | A | 6/1954 | Bradford | |
| 3,350,736 | A | 11/1967 | Frazelle et al. | |
| 4,224,712 | A | 9/1980 | Black et al. | |
| 4,403,366 | A | 9/1983 | Lucke | |
| 4,516,616 | A | 5/1985 | Fesler | |
| 4,771,502 | A | 9/1988 | Trimble | |
| 4,854,449 | A | 8/1989 | Fitzhugh | |
| 4,953,603 | A | 9/1990 | Holden | |
| 5,009,327 | A | 4/1991 | Levison | |
| D317,693 | S | 6/1991 | Jencks et al. | |
| 5,083,661 | A | 1/1992 | Burwell | |
| 5,092,013 | A | 3/1992 | Genovese, Jr. | |
| 5,161,683 | A | 11/1992 | Smith | |
| 5,244,278 | A * | 9/1993 | Robitaille | 383/4 |
| 5,372,414 | A | 12/1994 | Lamonakis et al. | |
| 5,419,477 | A * | 5/1995 | Verge | 224/274 |
| 5,526,924 | A * | 6/1996 | Klutznick | 206/5 |
| 5,927,489 | A | 7/1999 | Carswell | |
| 6,849,135 | B2 | 2/2005 | Jones | |
| D537,288 | S | 2/2007 | Jones | |
| 7,178,193 | B2 | 2/2007 | Jones | |
| 7,344,308 | B2 | 3/2008 | Meyer et al. | |
| 7,413,614 | B2 | 8/2008 | Jones | |
| 7,416,610 | B2 | 8/2008 | Jones | |
| 7,442,259 | B2 | 10/2008 | Jones | |
| 2002/0067866 | A1 * | 6/2002 | Moor et al. | 383/40 |
| 2007/0269259 | A9 * | 11/2007 | Shaw | 401/201 |

* cited by examiner

*Primary Examiner* — Robert Scruggs
(74) *Attorney, Agent, or Firm* — Craig A. Fieschko, Esq.; DeWitt Ross & Stevens S.C.

(57) ABSTRACT

Disclosed is a towel including a pouch provided integrally with a cover unit selectively closing an opening formed at one side thereof, and a towel body kept in the pouch and selectively taken out of the pouch so as to be used. Since the towel body kept in the pouch is selectively taken out of the pouch so as to be used, the towel does not obstruct outdoor activities, and is handy to carry about and keep.

23 Claims, 10 Drawing Sheets

TOWEL

CROSS-REFERENCE TO RELATED APPLICATIONS

This application is a continuation-in-part under 35 USC §365(c) of International (PCT) Application PCT/KR2007/003804, having an international filing date of 8 Aug. 2007, the entirety of which is incorporated by reference herein.

FIELD OF THE INVENTION

The present invention relates to a towel, and more particularly to a towel, which has good portability and storability so as to increase the convenience of use.

BACKGROUND OF THE INVENTION

In general, towels are nappy cotton goods, which are woven out of a cotton yarn and are used to wipe away moisture, sweat, or various foreign substances from the face or the body. These towels are provided with uncut piles therein or on the surface thereof, and thus have excellent moisture absorptiveness and air ventilation. The towels are divided into a bathing towel having a large size, a washing towel having a middle size, a towel handkerchief put into a pocket, a towel for wiping away sweat during exercise or work, etc., according to purpose. A textile woven for towels is called "a piece of toweling," and effectively absorbs moisture, thus being used to produce a single layered coverlet, serving as a summer coverlet, or a pajama.

In the case that a person works at a civil engineering and construction site or a factory, climbs a mountain, or gets exercise, the person sweats at his/her face and/or body or various foreign substances are stuck to his/her face and/or body. When moisture or sweat is put into eyes and/or a part of the body, a person cannot concentrate on various works or exercise. Accordingly, the person needs to carry a towel for wiping away moisture, sweat, and/or various foreign substances.

Generally, conventional towels are partially put into a pocket of user's pants or put around user's neck.

Accordingly, the conventional towels are disadvantageous in that the towels are not handy to carry about, are easily separated from user's body, and cannot be effectively used. That is, conventional towels are unhandy to carry about and keep.

Further, since the conventional towels cannot easily evaporate moisture wiped from user's face or parts of user's body, when the towels are continuously used for a long time, the towels smell sweaty and become wet.

SUMMARY OF THE INVENTION

The present invention has been made in view of the above problems, and it is an object of the present invention to provide a towel, which is handy to carry about and keep, and easily evaporates absorbed moisture to the outside, thus greatly increasing the convenience of use.

It is another object of the present invention to provide a towel, in which a pouch having a reception space formed therein and a towel body made of a functional fabric, such as a micro fiber, are detachably attached to each other so as to facilitate the washing of the towel body and not to limit the range of use of the towel body, thus increasing the convenience of use and improving the degree of freedom in designing a product.

These and other objects can at least partially be met by the provision of a towel comprising a pouch provided with an opening formed at one side thereof; a reception space formed therein; plurality of air holes formed through the external surface thereof; a cover unit opening and closing the opening of the pouch; a towel body connected to any one of the pouch and the cover; and a first fastener provided at regions of the pouch and the cover unit adjacent to each other for detachably attaching the pouch and the cover unit to each other.

Preferably, a second fastener for detachably attaching the pouch to a target object is provided at one surface of the pouch.

More preferably, the second fastener is provided on the rear surface of the pouch, and includes an adhesion band provided with cutoff slots.

Further, preferably, the towel body is detachably connected to any one of the pouch and the cover unit.

The invention is exemplified by a towel which has a pouch provided integrally with a cover unit selectively closing an opening formed at one side thereof, and a towel body kept in the pouch and selectively taken out of the pouch so as to be used, wherein the towel body is provided integrally with a towel connection strap having a designated length formed at one end thereof, the pouch is provided with an aperture formed through a position thereof opposite to the opening, and connectors for selectively attaching and detaching the towel body and the pouch to and from each other are respectively provided at one end of the towel connection strap and one side of the external surface of the pouch.

Preferably, the connectors are a pair of Velcro tapes.

The invention is also exemplified by a towel which has a pouch provided integrally with a cover unit selectively closing an opening formed at one side thereof, and a towel body kept in the pouch and selectively taken out of the pouch so as to be used, wherein the towel body is provided integrally with a towel connection strap having a designated length formed at one end thereof, the pouch is provided integrally with a end connector strap, which may be formed as a band having its ends affixed to the end of the pouch at a position thereof opposite to the opening, and connectors for selectively connecting and disconnecting the towel connection strap and the end connector strap to and from each other by an elastic fit are respectively provided on the towel connection strap and the end connector strap.

Preferably, the connectors include an insert provided with a pair of elastic pieces, and a receptor provided with a groove, into which the elastic pieces of the insert are elastically fitted.

Further, preferably, one end of the end connector strap extends to the outside of the pouch and is then doubled back and joined to the pouch to form a loop.

The invention is further exemplified by a towel which has a pouch provided integrally with a cover unit selectively closing an opening formed at one side thereof, and a towel body kept in the pouch and selectively taken out of the pouch so as to be used, wherein the towel body is provided integrally with a towel connection strap having a designated length formed at one end thereof, the pouch is provided with a aperture formed through a position thereof opposite to the opening, and connectors for selectively connecting and disconnecting the towel body and the pouch to and from each other by an elastic fit are respectively provided at one end of the towel connection strap and one side of the external surface of the pouch.

Preferably, the connectors are respectively provided at both ends of an extension band, one end of which passes through the aperture, the end of the towel connection strap, and the side of the external surface of the pouch, and include inserts, each of which is provided with a pair of elastic pieces having elastic displacement, and receptors, each of which is provided with a groove, into which the pair of elastic pieces of the corresponding one of the inserts is elastically fitted.

The present invention provides a towel, which is handy to carry about and keep, and easily evaporates absorbed moisture to the outside, thus greatly increasing the convenience of use.

Further, the towel of the present invention includes a pouch and a towel body, which are easily attached to or detached from each other only by a simple manipulation, so as to facilitate the washing of the towel body and easily replace the worn-out towel body with a new one, thus increasing customer's satisfaction for a product. Further, in the case that the pouch is fixed to a bag or clothes through a connecting ring, it is not necessary to separate the pouch from the bag or clothes but only the towel body may be separated from the pouch. Thus, compared with conventional towels, the towel of the present invention does not to limit the range of use of the towel body, thus increasing the convenience of use.

Particularly, the connecting structure between the pouch and the towel body increases the degree of freedom in designing of a product, and thus the increase of the competitive power of a product is expected.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF PREFERRED VERSIONS OF THE INVENTION

Now, preferred embodiments of the present invention will be described in detail with reference to the annexed drawings.

FIGS. 1 to 4 illustrate a towel in accordance with one embodiment of the present invention.

As shown in FIGS. 1 to 4, the towel 1 of this embodiment includes a pouch 10, a cover unit 15, and a towel body 20.

Figure 2:
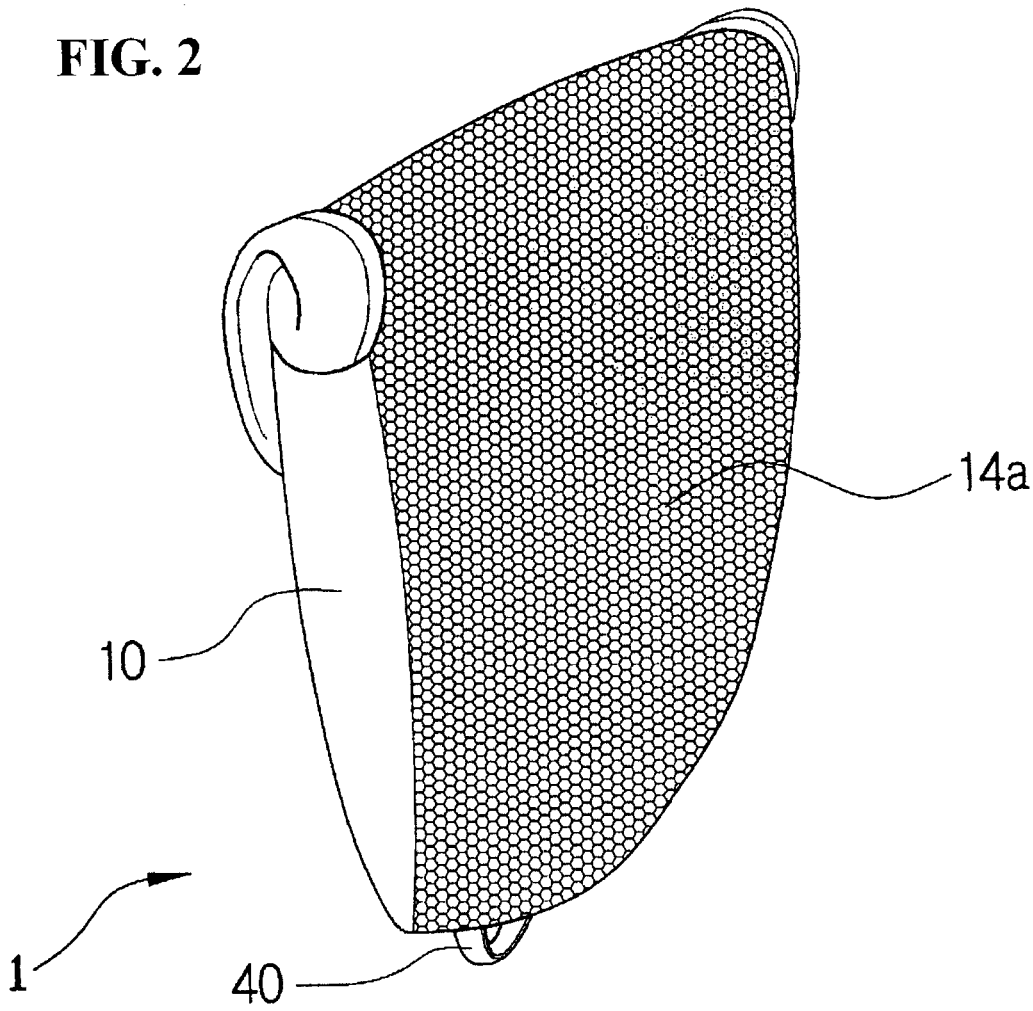
Figure 3:
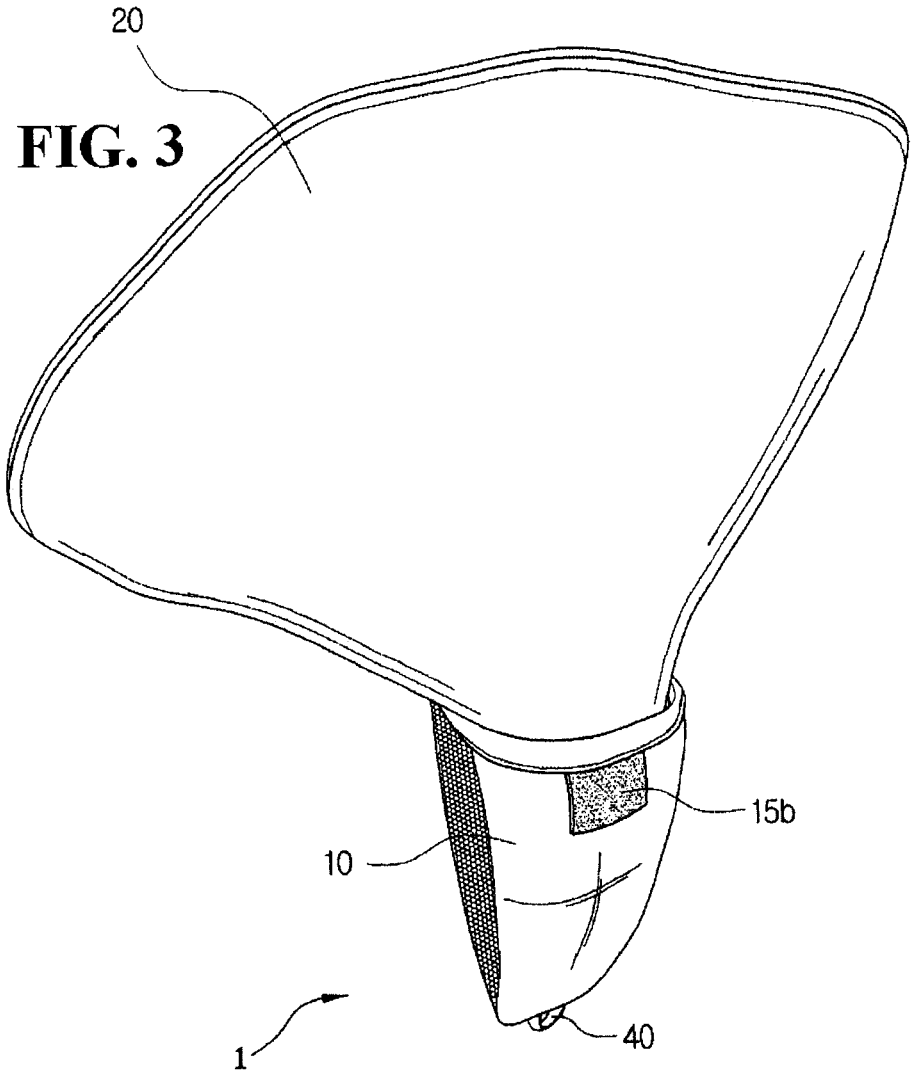

The pouch 10 is provided with an opening 12 formed at one side thereof, and a reception space 10*a* formed therein for receiving the towel body 20 in a folded state. A plurality of air holes 14*a* is formed through a part or the entire region of the pouch 10, as shown in FIG. 2, and thus remarkably improves the air ventilation of the towel body 20 received in the pouch 10.

The cover unit 15 is provided integrally with the opening 12 of the pouch 10, and serves to open and close the opening 12 of the pouch 10.

A first fastener for maintaining the closed state of the opening 12 of the pouch 10 by the cover unit 15 is provided at regions of the cover unit 15 and the pouch 10 adjacent to each other.

Figure 1:
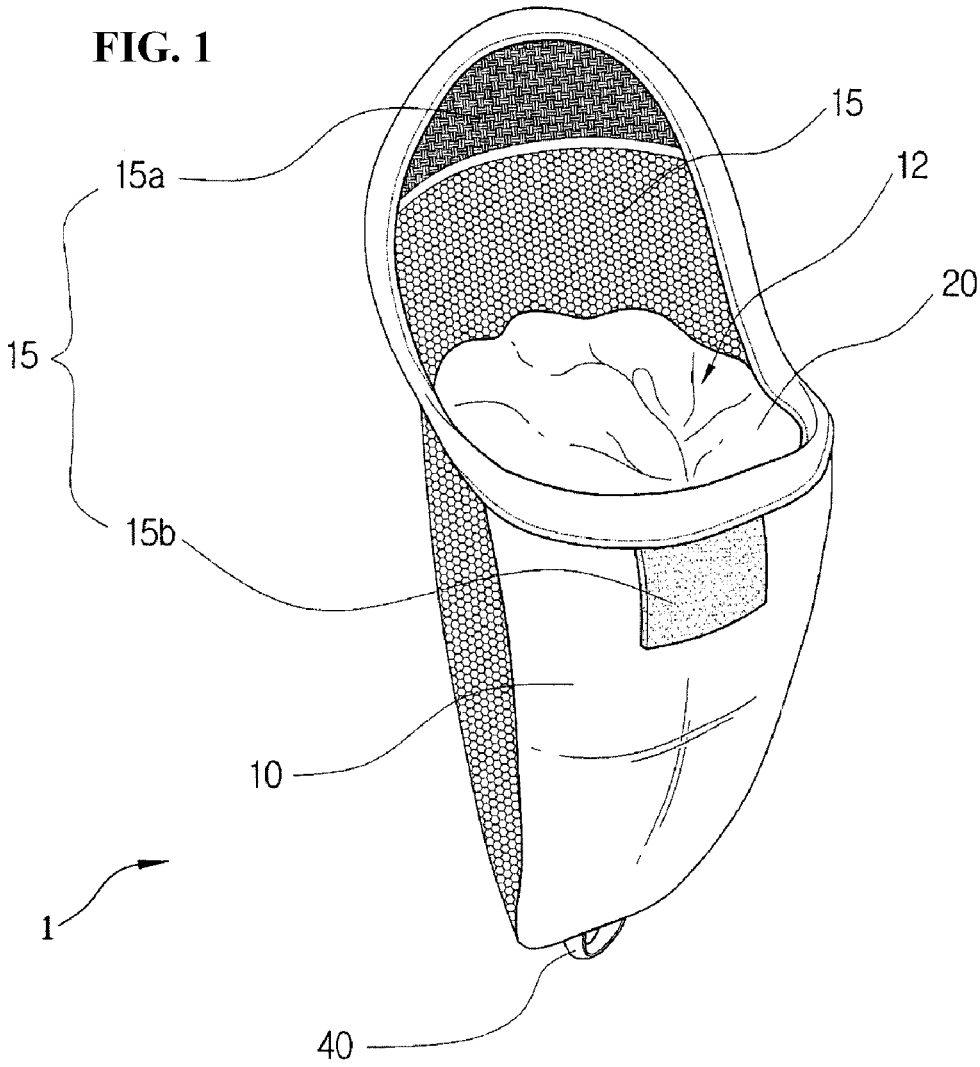
FIGS. 1 to 4 are views illustrating a towel in accordance with one embodiment of the present invention.

Although FIG. 1 illustrates fastener parts 15*a* and 15*b* employing Velcro fasteners as the first fastener, the fastener parts 15*a* and 15*b* are not limited thereto but may employ various fastener parts, such as snap fasteners, locking hooks, and various buttons.

The towel body 20 is fixedly connected or detachably connected to one side surface of the pouch 10 or the cover unit 15.

Figure 4:
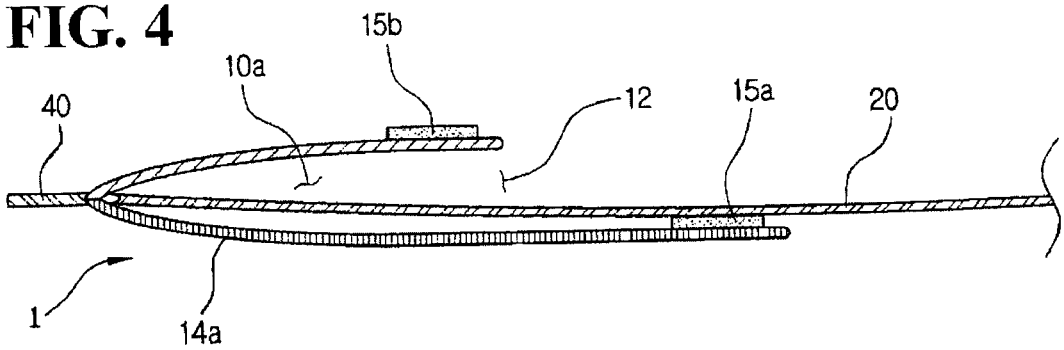

More specifically, the towel body 20 is fixedly connected to the inner surface of the pouch 10, as shown in FIG. 4, or is fixedly connected to the inner surface of the cover unit 15. When the towel body 20 is folded and received in the reception space 10*a* of the pouch 10, the towel body 20 is not exposed to the outside.

Preferably, the towel body 20 is mainly made of a micro fiber cloth, and thus the towel of the present invention is advantageous in that the towel body 20 effectively absorbs moisture, removes foreign substances, and evaporates the absorbed moisture.

A second fastener 40 is provided at one side of the pouch 10, as shown in FIGS. 1 and 2.

The second fastener 40 serves to detachably attach the pouch 10 to a user's clothes or belt. FIGS. 1 and 2 illustrate the second fastener 40 having a detachable ring shape.

However, the second fastener 40 is not limited to the ring shape, as shown in FIGS. 1 to 4, the second fastener 40 may employ detachable fastener parts having various shapes, such as a Velcro fastener and a snap fastener.

Hereinafter, the use of the above-described towel in accordance with this embodiment will be described.

While a user carries the towel by attaching the second fastener 40 of the pouch 10 to his/her clothes or belt, in order to wipe away moisture or sweat from a part of the user's body, such as the face, the user opens the cover unit 15 distant from the pouch 10, and unfolds the towel body 20 in the pouch 10 and uses the unfolded towel body 20.

Thereafter, when the user wants to keep the towel body 20 in the pouch 10 again, the user folds the towel body 20 and then puts into the folded towel body 20 into the reception space 10*a*.

Figure 5:
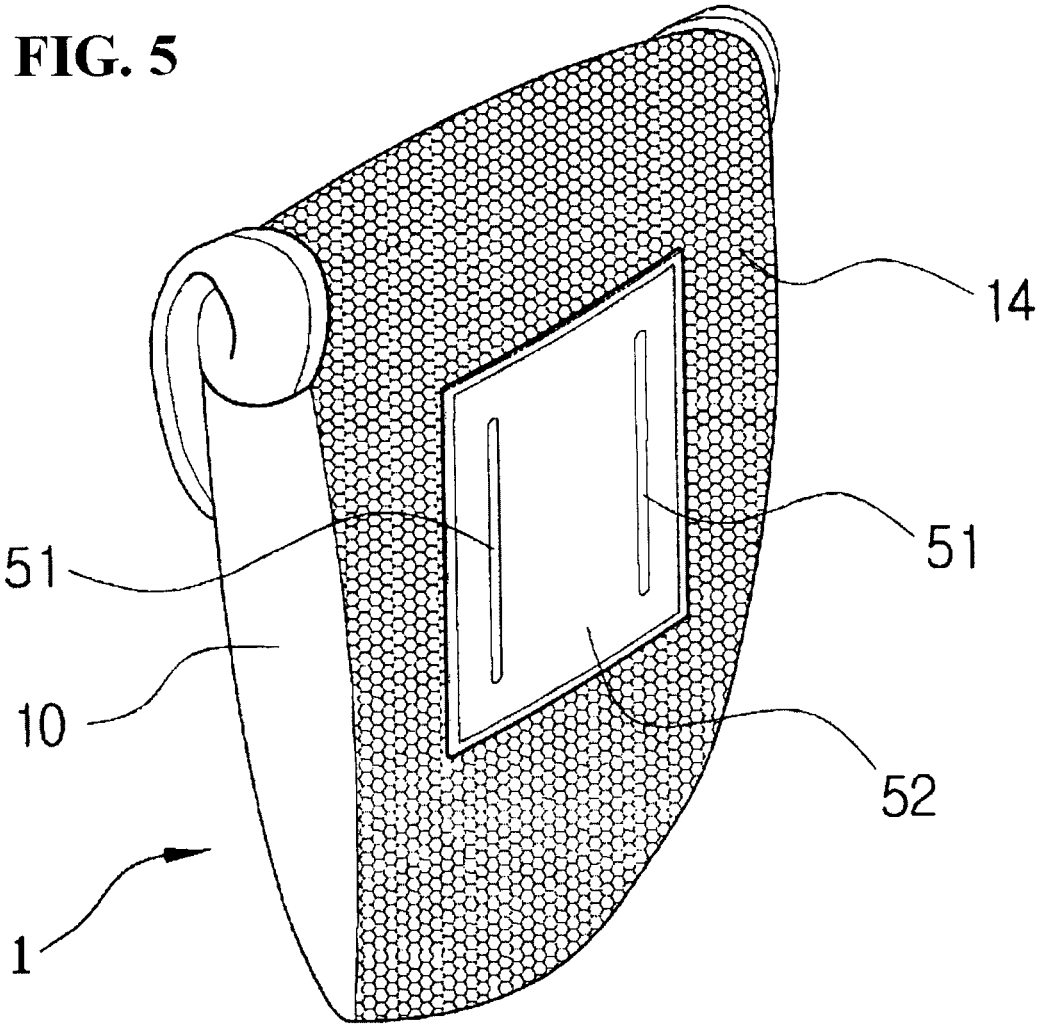
FIG. 5 is a perspective view illustrating the rear surface of a towel in accordance with another embodiment of the present invention.

Alternatively, as shown in FIG. 5, a second fastener 50 includes an adhesion band 52, through which cutoff slots 51 are formed, attached to one surface, preferably, the rear surface, of the pouch 10.

The adhesion band 52 causes the user's belt to be inserted whereinto through the cutoff slots 51, thus allowing the user to easily carry and keep the towel.

As described above, after the towel body 20 is kept in the pouch 10, the towel body 20 is easily used in case of need, and thus the convenience of use of the towel of the present invention is greatly increased.

Further, the towel body 20 is mainly made of a micro fiber, and thus the towel of the present invention is advantageous in that the towel body 20 effectively absorbs moisture, removes foreign substances, and evaporates the absorbed moisture.

Figure 6:
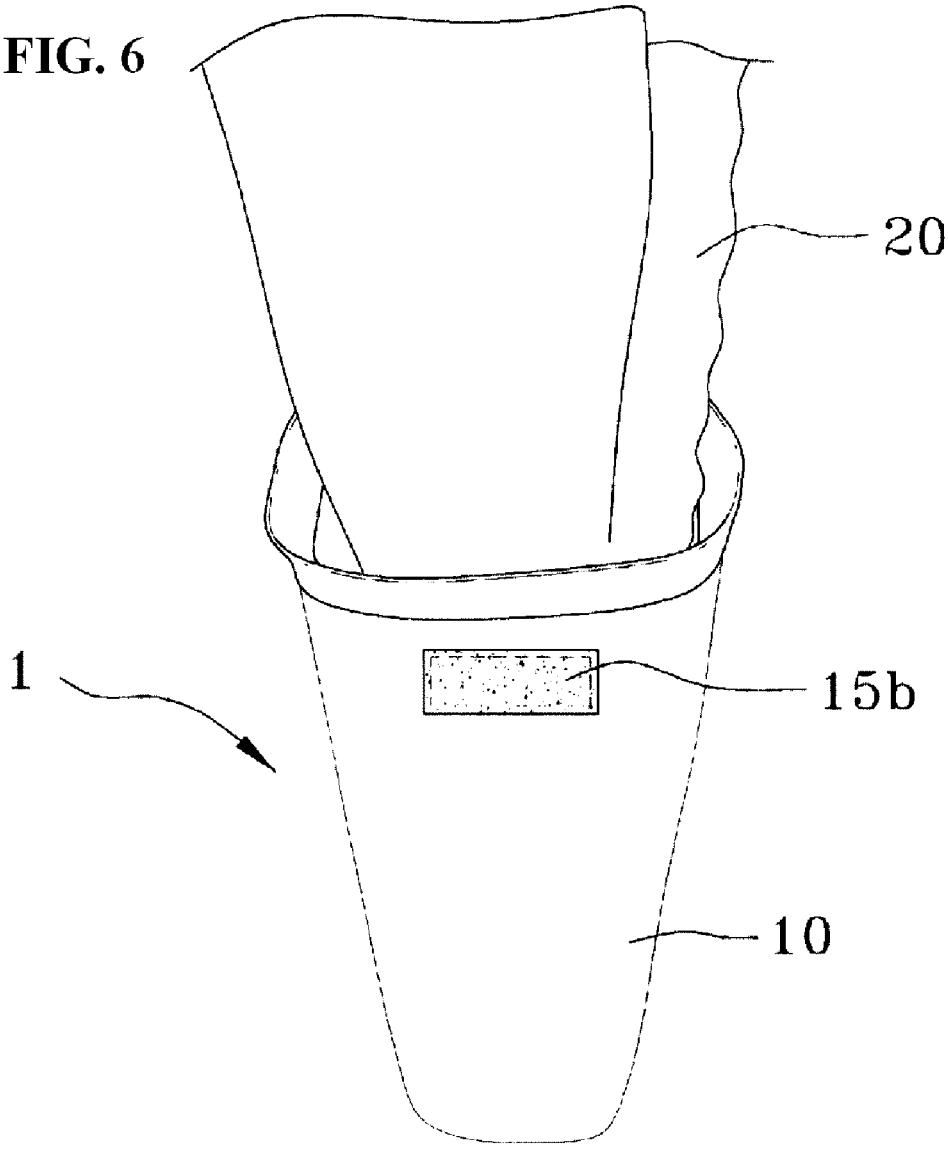
FIGS. 6 and 7 are views illustrating a towel in accordance with another embodiment of the present invention.
Figure 7:
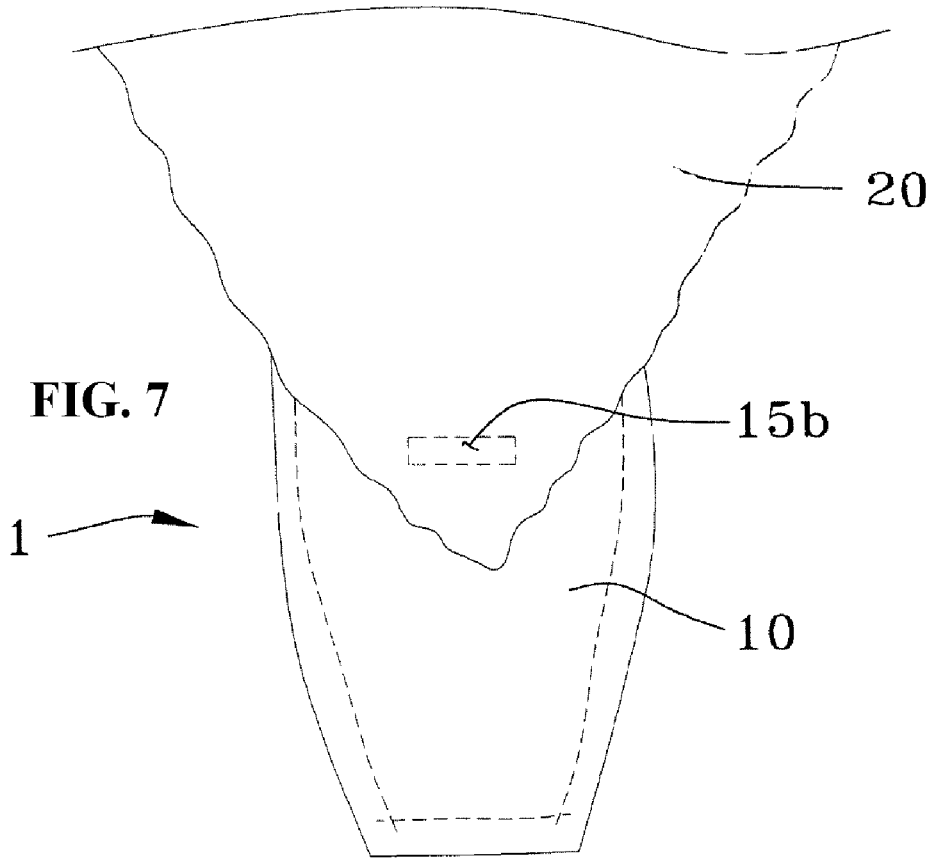

FIGS. 6 and 7 are views illustrating a towel in accordance with another embodiment of the present invention.

As shown in FIGS. 6 and 7, the towel body 20 of the towel 1 of this embodiment is integrally fixed to the fastener part 15*b*, which employs a Velcro fastener so as to selectively close an opening of the pouch 10, by sewing.

The towel 1 of this embodiment, in which one end of the towel body 20 is fixed to the fastener part 15*b* of the pouch 10 by sewing, shortens a man-hour needed for production, compared with the towel of the former embodiment, and thus improves productivity and reduces production costs. Further, since the drawing position of the towel part 20 out of the pouch 10 is close to the cover unit 15, the length of the towel part 20 drawn out of the pouch 10 is elongated.

Figure 8:
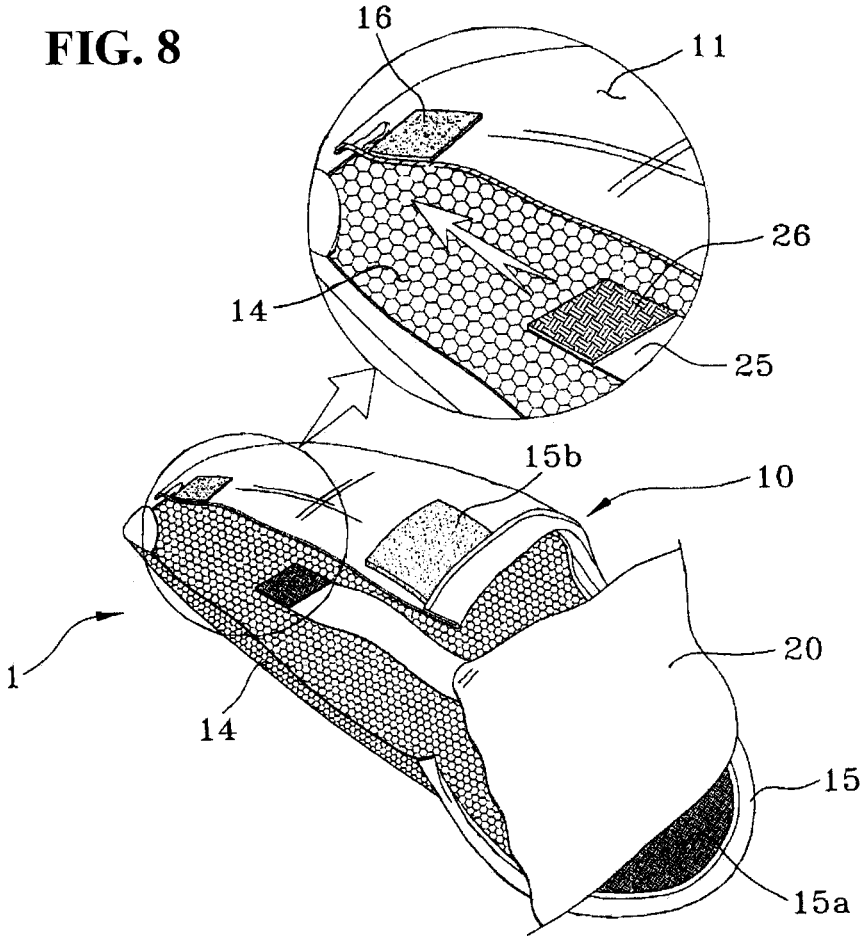
FIGS. 8 and 9 are partially exploded perspective views illustrating a towel in accordance with another embodiment of the present invention.
Figure 9:
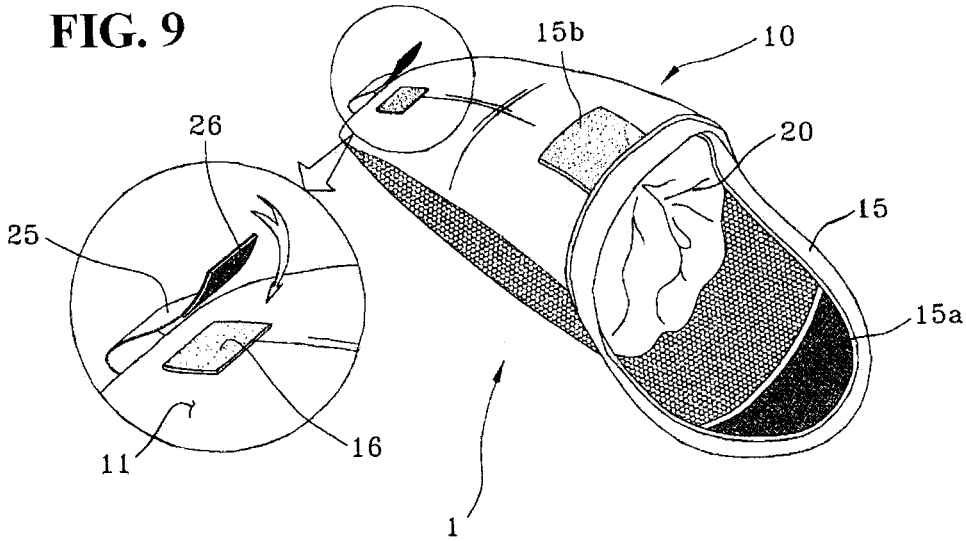
Figure 10:
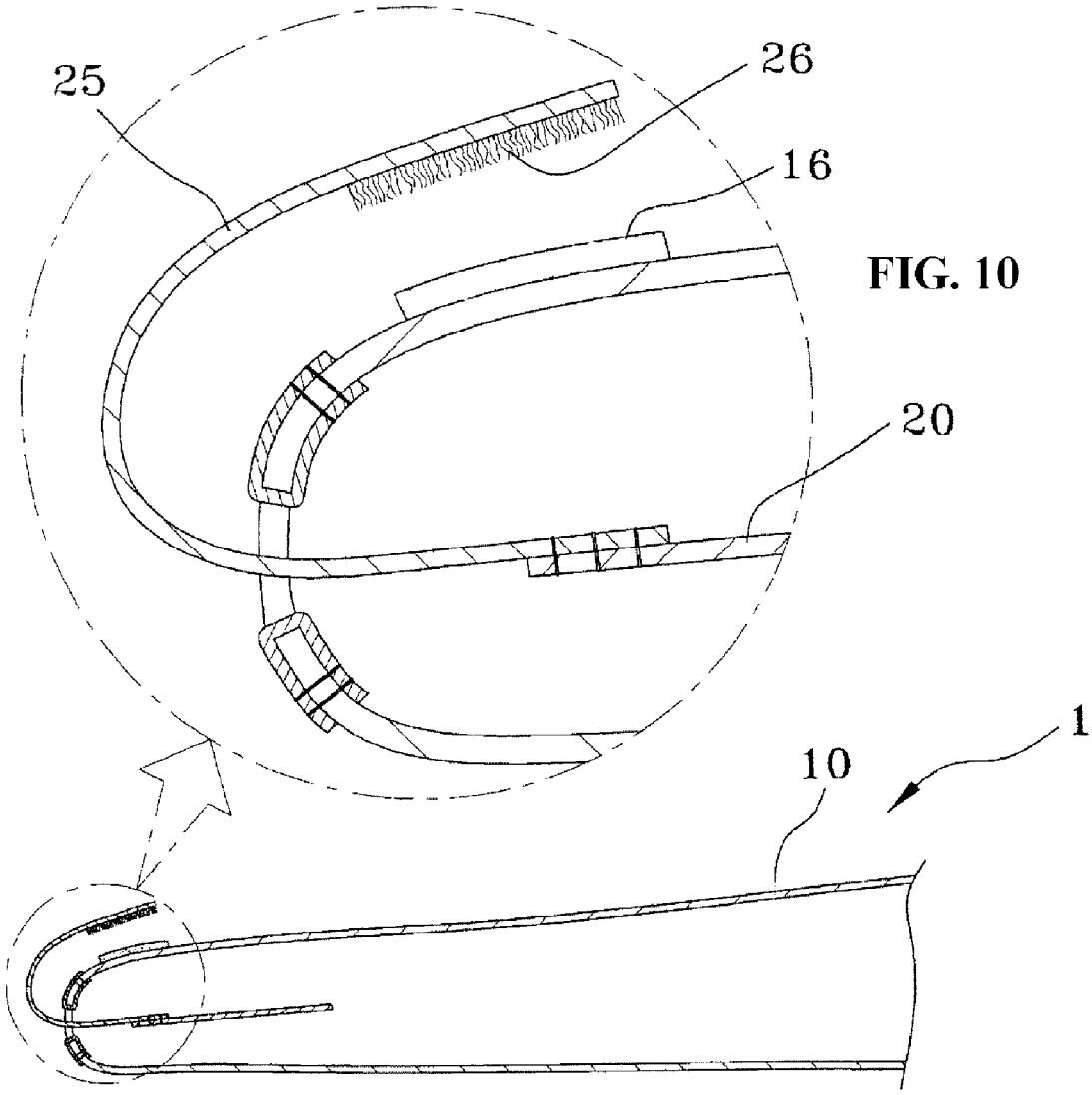
FIG. 10 is a sectional view of an essential portion of a towel in accordance with another embodiment of the present invention.

FIGS. 8 and 9 are partially exploded perspective views illustrating a towel in accordance with another embodiment of the present invention.

As shown in FIGS. 8 and 9, a towel 1 of this embodiment includes a pouch 10 having a bag shape for providing a reception space formed therein, and a towel body 20 received in the pouch 10 and selectively withdrawn to the outside so as to be used.

The pouch 10 forms the reception space having a designated size therein, and an opening (without reference numeral) for putting or taking the towel body 20 into or out of the pouch is formed through one side of the pouch 10.

Such a pouch 10 is obtained by sewing two different fabrics integrally. As shown in FIGS. 8 and 9, one surface of the pouch 10 forms a shielding surface 11 made of a fabric woven by a synthetic yarn, a natural yarn, or a composition thereof, and the other surface of the pouch 10 forms a ventilating surface 14 made of a mesh net provided with air holes formed therethrough at uniform spacings so as to assure the air ventilation of the towel body 20 received in the pouch 10. Here, a cover unit 15 having a size enough to close the opening of the pouch 10 is formed integrally with the ventilating surface 14.

Fastener parts 15*a* and 15*b* employing Velcro fasteners are respectively provided on the cover unit 15 and the shielding surface 11. Thus, the opening of the pouch 10 is closed by attaching the fastener parts 15 and 15*b* to each other under the condition that the cover unit 15 is folded toward the shielding surface 11. The fastener parts 15*a* and 15*b* provided on the cover unit 15 and the shielding surface 11 are not limited to the Velcro fasteners, but may employ snap fasteners, or various buttons or strings.

The towel body 20 is kept in the pouch 10, and then is selectively taken out of the pouch 10 by a user. The towel body 20 is made of a fabric, which easily absorbs and evaporates sweat or moisture and removes foreign substances, and is preferably made of a cotton fabric or a functional fabric, such as a micro fiber. When the towel body 20 is not in use, the towel body 20 is folded and kept in the pouch 10, and is not exposed to the outside by closing the opening of the pouch 10 with the cover unit 15.

The above constitution of the towel 1 of this embodiment is substantially similar to that of the towel of the former embodiment. However, the towel 1 of this embodiment is characterized in that the pouch 10 and the towel body 20 can be selectively separated from each other.

That is, the towel 1 having the below constitution allows the pouch 10 and the towel body 20 to be selectively separated from each other.

An aperture or through hole (h) is formed through a position of the pouch 10 opposite to the opening, through which the towel body 20 is taken out of the pouch 10 or is inserted into the reception space in the pouch 10. Preferably, the aperture (h) has a smaller size than that of the opening.

Further, a pouch end connector 16 is provided at one side of the shielding surface 11 close to the aperture (h). Here, the pouch end connector 16 is obtained by sewing a Velcro strap on the pouch 10.

The towel body 20 is a fabric having a regular square or rectangular shape. A towel connection strap 25 having a designated length is connected integrally to one corner of the towel body 20. A strap connector 26, which is selectively attached to and detached from the pouch end connector 16 of the shielding surface 11, is provided at one end of the towel connection strap 25. Here, the strap connector 26 is obtained by sewing a Velcro strap on the towel connection strap 25.

Figure 12:
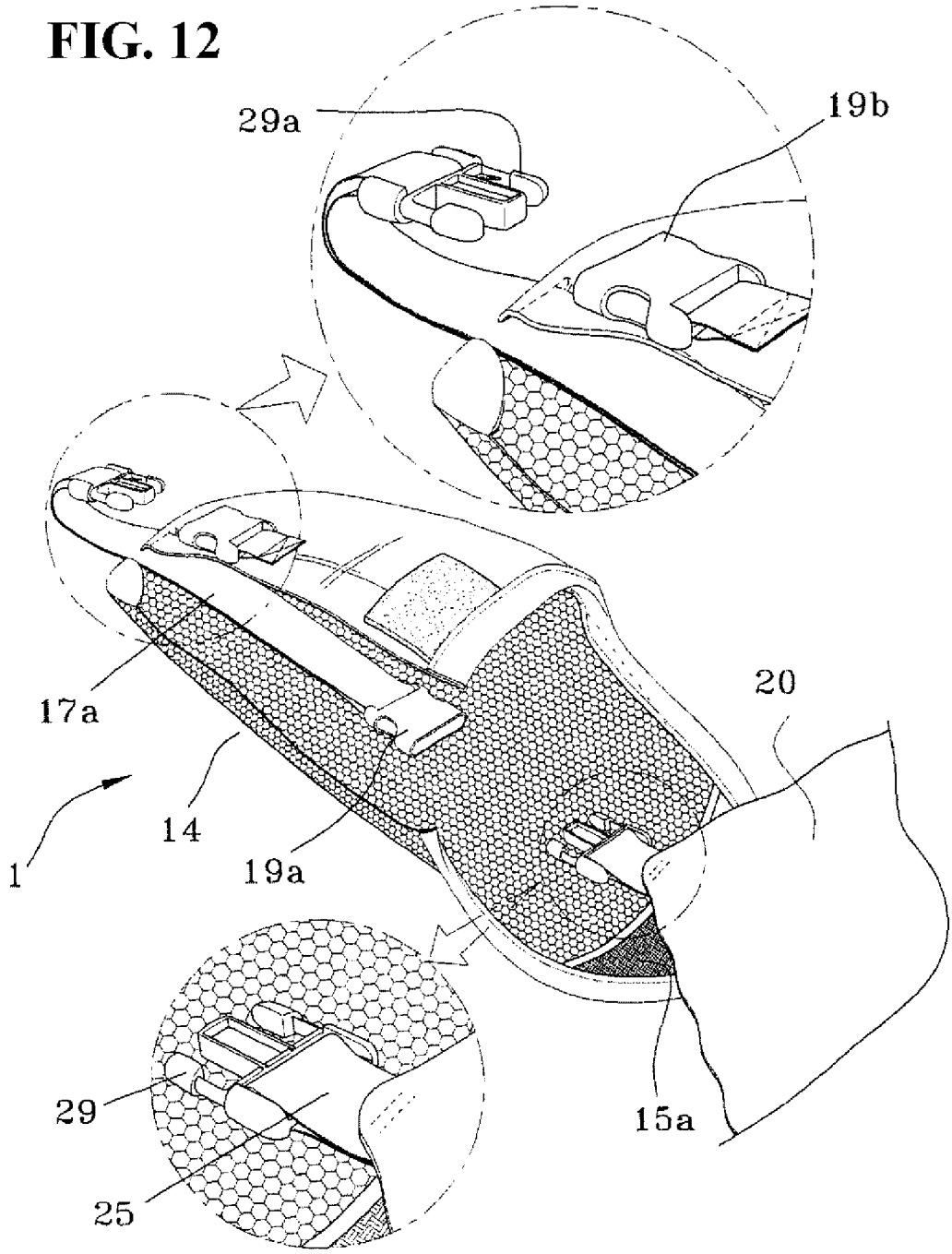
FIG. 12 is a partially exploded perspective view illustrating a towel in accordance with yet another embodiment of the present invention.

The towel body 20 maintains its fixed state by inserting the towel connection strap 25 into the aperture (h) of the pouch 10 and attaching the strap connector 26 to the pouch end connector 16 provided on the shielding surface 11. Here, in order to connect the towel connection strap 25 to a bag or clothes, one side of the towel connection strap 25 may have a loop shape, as shown in FIGS. 8 and 9, or a connection ring (c), as shown in FIG. 12, may be connected to the towel connection strap 25.

Preferably, the connection part 16 provided on the shielding surface 11 of the pouch 10 and the strap connector 26 provided on the towel connection strap 25 of the towel body 20 employ Velcro fasteners. However, the pouch end connector 16 and the strap connector 26 may employ snap fasteners or strings, which are attached to and detached from each other. Hereinafter, the use of the above-described towel in accordance with this embodiment will be described.

In order to use the towel body 20 kept in the pouch 10, a user unfolds the cover unit 15, closing the opening of the pouch 10, in a direction for separating the cover unit 15 from the shielding surface 11, thereby opening the opening of the pouch 10. Thereafter, the user draws the towel body 20 out of the pouch 10. Thus, the towel body 20 is unfolded so as to wipe away sweat or moisture.

When the user wants to keep the towel body 20 in the pouch 10 again after the use of the towel body 20 is finished, the user folds the towel body 20 and then puts into the folded towel body 20 into the pouch 10 through the opening. Thereafter, the user folds the cover unit 15 to the shielding surface 11, and attaches the cover unit 15 and the shielding surface 11 to each other using the fastener parts 15*b* and 15*a*.

The towel body 20 is selectively separated from the pouch 10 by inserting the towel connection strap 25 connected to the towel body 20 into the aperture (h) of the pouch 10 and attaching and detaching the pouch end connector 16 and the strap connector 26 provided on the shielding surface 11 and the towel connection strap 25 to and from each other.

Since the towel body 20 is selectively separated from the pouch 10, it is possible to effectively wash the towel body 20 and replace the worn-out towel body 20 with a new one. Further, in the case that the pouch 10 is fixed to a bag or clothes, the range of use of the towel body 20 is not limited, and thus the convenience of use of the towel 1 is assured.

Figure 11:
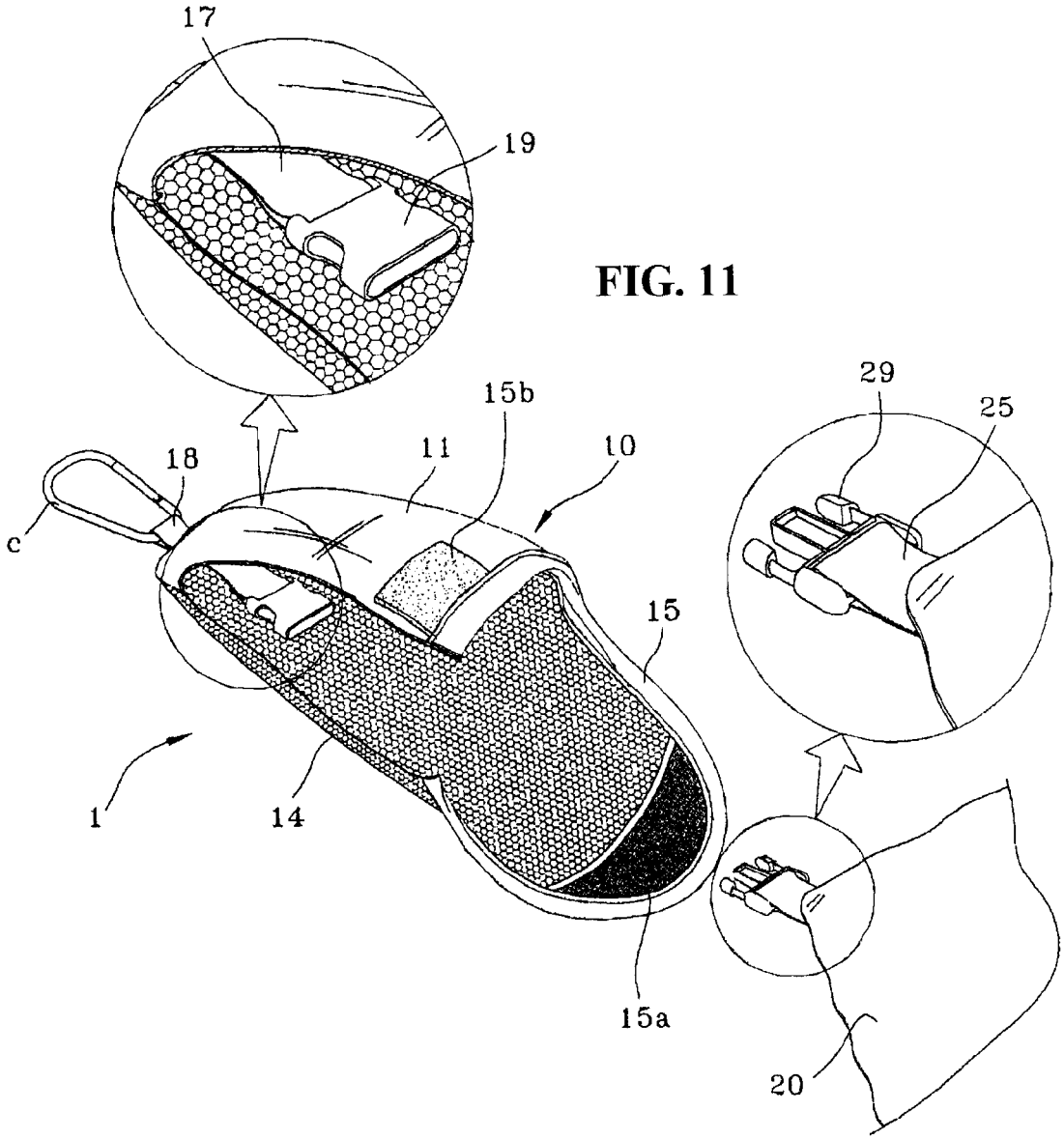
FIG. 11 is a partially exploded perspective view illustrating a towel in accordance with another embodiment of the present invention.

FIG. 11 is a partially exploded perspective view illustrating a towel in accordance with another embodiment of the present invention.

As shown in FIG. 11, a towel 1 of this embodiment includes a pouch 10 having a bag shape for providing a reception space formed therein, and a towel body 20 received in the pouch 10 and selectively drawn to the outside so as to be used.

The above constitution of the towel 1 of this embodiment is substantially similar to that of the towel of the former embodiment. However, the towel 1 of this embodiment is characterized in that the pouch 10 and the towel body 20 can be selectively separated from each other by connectors for maintaining the firm connection between the pouch 10 and the towel body 20 without using Velcro fasteners.

That is, a end connector strap 17, both ends of which extend between the inside and the outside of the pouch 10, is provided at a position of the pouch 10 opposite to an opening, through which the towel body 20 is taken out of the pouch 10 or is folded and inserted into the reception space in the pouch 10, by sewing. Here, a fabric having a designated width is used as the end connector strap 17, and one end of the end connector strap 17 exposed to the outside forms a loop 18. The connection ring (C), which is connected to the loop 18, as shown in FIG. 11, or the loop 18 may be connected to a bag or clothes.

A towel connection strap 25 having a designated length is connected integrally to one corner of the towel body 20.

Connectors, for elastically connecting and disconnecting the end connector strap 17 of the pouch 10 and the towel connection strap 25 of the towel body 20 to and from each other, are provided. The connectors are well known, and include an insert provided with a pair of elastic pieces, and a receptor provided with a groove, into which the elastic pieces of the insert are elastically fitted.

In this embodiment, as shown in FIG. 11, a receptor 19 is connected to one end of the end connector strap 17, and an insert 29 is connected to the tip of the towel connection strap 25 of the towel body 20. However, the connectors are not limited thereto, and the positions of the receptor 19 and the insert 29 may be reversed.

In the towel of this embodiment, since the towel body 20 is selectively separated from the pouch 10 by the receptor 19 provided on the pouch 10 and the insert 29 provided on the towel body 20, in the same manner as the former embodiment, it is possible to effectively wash the towel body 20 and replace the worn-out towel body 20 with a new one. Further, in the case that the pouch 10 is fixed to a bag or clothes, the range of use of the towel body 20 is not limited, and thus the convenience of use of the towel 1 is assured.

FIG. 12 is a partially exploded perspective view illustrating a towel in accordance with yet another embodiment of the present invention.

As shown in FIG. 12, a towel 1 of this embodiment includes a pouch 10 having a bag shape for providing a reception space formed therein, and a towel body 20 received in the pouch 10 and selectively drawn to the outside so as to be used.

The above constitution of the towel 1 of this embodiment is substantially similar to that of the towel of the former embodiment. However, the towel 1 of this embodiment is characterized in that a aperture (without reference numeral) is formed at a position of the pouch 10 opposite to an opening of the pouch 10, one end of an extension strap 17*a* having a designated length is inserted into the aperture, a receptor 19*a*, into which an insert 29 provided on a towel connection strap 25 of the towel body 20 is fitted, is connected one end of the extension strap 17*a*, and an insert 29*a*, which is elastically fitted into a receptor 19*b* connected to one end of the external surface of the pouch 10, is connected to the other and of the extension strap 17*a*.

Thereby, the extension strap 17*a*, after passing through the aperture formed through the pouch 10, defines a loop, and a connection ring may be connected to the loop-shaped portion of the extension band 17*a*.

In the towel 1 of this embodiment, the insert 29*a* and the receptor 19*a* provided on both ends of the extension band 17*a* are respectively connected to the receptor 19*b* provided on the external surface of the pouch 10 and the insert 29 provided on the towel body 20. The use of the towel 1 of this embodiment is the same as the towel of the former embodiment, and a detailed description thereof will be thus omitted.

The various versions of the invention may include other features as well. As an example, an fastening strap or straps may be added which extends from the pouch in a direction perpendicular (or approximately so) to the axis extending between the opening and the pouch end (and any aperture/through hole defined through the pouch aperture). This fastening strap or straps can then extend from the pouch about (for example) a shoulder strap of a backpack, golf bag, or the like, and then can connect to the pouch (or to an opposite strap) to hold the pouch on the shoulder strap. For example, in FIG. 6, a fastening strap could be affixed to the rear of the pouch, at roughly the height of the fastener part 15*b*, and could extend outwardly from the opposing sides of the pouch to terminate in opposing ends having fasteners thereon (e.g., hook-and-loop fastener). The opposing ends of the fastening strap could then be affixed together about an object (e.g., a shoulder strap) to affix the pouch to the object.

Although preferred versions of the invention have been described for illustrative purposes, those skilled in the art will appreciate that various modifications, additions and substitutions are possible, without departing from the scope and spirit of the invention as disclosed in the accompanying claims.

What is claimed is:

1. A towel including:

a. a towel body having a towel connection strap extending therefrom, the towel connection strap terminating in a strap connector;

b. a pouch having:

(1) an internal reception space therein, (2) an opening in communication with the reception space, (3) a pouch end opposite the opening, the pouch end having a pouch end connector thereon, the pouch end connector being configured to removably attach to the strap connector;

(4) a cover unit partially bounding the opening, the cover unit being foldable over the opening to close the opening, the pouch being formed of:

(a) a shielding surface defining an at least substantially continuous area of fabric between the pouch end and the opening; and (b) a ventilating surface extending adjacent the shielding surface between the pouch end and the opening, the ventilating surface containing air holes extending between the exterior of the pouch and the reception space, c. a towel body connected to one of the pouch and the cover unit, the towel being sized such that it can be:

(1) fully received within the opening and the internal reception space with the cover unit closing the opening, and (2) extended from the pouch with at least a major portion of the towel body being outside of the opening and the internal reception space.

2. The towel of claim 1 wherein at least half of the area of the ventilating surface is defined by air holes.

3. The towel of claim 1 wherein the air holes are adjacently arrayed over approximately half or more of the area of the ventilating surface, with the towel body being clearly visible through the air holes from the exterior of the pouch when the pouch is situated inside the reception space.

4. The towel of claim 1 wherein:

a. both the shielding surface and the ventilating surface have opposing lateral sides extending between the pouch end and the opening, and b. the lateral sides of the shielding surface are joined to the lateral sides of the ventilating surface.

5. The towel of claim 1 wherein the pouch end connector is connected to the pouch end via an elongated end connector strap, wherein the pouch end and the pouch end connector are at opposite ends of the length of the end connector strap.

6. The towel of claim 5 wherein the end connector strap defines a loop encircling a portion of the pouch end connector.

7. The towel of claim 5 wherein the end connector strap terminates at, and is affixed to, the pouch end within the reception space.

8. The towel of claim 1 wherein the pouch end has an aperture defined therein through which the towel connection strap extends.

9. The towel of claim 8 wherein the pouch end connector is situated on the shielding surface outside of the reception space.

10. The towel of claim 1 further including first fasteners situated at opposing regions of the pouch and the cover unit such that when the cover unit closes the opening, the first fasteners detachably affix the pouch and the cover unit to each other.

11. The towel of claim 1 further including an adhesion band situated on an exterior surface of the pouch, the adhesion band including a pair of spaced cutoff slots thereon, with a passage being defined:

a. between the cutoff slots, and b. between the adhesion band and the exterior surface of the pouch.

12. A towel including:

a. a pouch having:

(1) an internal reception space therein, (2) an opening at a first pouch end, the opening being in communication with the reception space, (3) a second pouch end opposite the first pouch end, (4) a cover unit opening and closing the opening, (5) first fasteners situated at opposing regions of the pouch and the cover unit such that when the cover unit closes the opening, the first fasteners detachably affix the pouch and the cover unit to each other, (6) several air holes extending through the pouch between the exterior of the pouch and the reception space, b. a towel body having a towel connection strap extending therefrom, the towel connection strap being fixed to the second pouch end, the towel being sized such that it can be:

(1) fully received within the opening and the internal reception space with the cover unit closing the opening, and (2) extended from the pouch with at least a major portion of the towel body being outside of the opening and the internal reception space.

13. The towel of claim 12 wherein the towel connection strap has a strap connector opposite the towel, wherein the towel body and the strap connector are at opposite ends of the length of the towel connector strap, the strap connector being affixed to a pouch end connector at the second pouch end.

14. The towel of claim 13 wherein:

a. the pouch end connector is situated outside of the reception space on an exterior surface of the pouch, and b. the second pouch end has an aperture defined therein through which the towel connection strap extends.

15. The towel of claim 12 wherein the air holes are sized and spaced such that the towel body is clearly visible from the exterior of the pouch when situated inside the reception space.

16. The towel of claim 12 wherein the air holes are adjacently arrayed over approximately half or more of the area of the pouch, with the towel body being clearly visible through the air holes from the exterior of the pouch when the pouch is situated inside the reception space.

17. A towel including:

a. a towel body having a towel connection strap extending therefrom, the towel connection strap terminating in a strap connector;

b. a pouch having:

(1) an internal reception space therein, (2) an opening in communication with the reception space, (3) a pouch end opposite the opening, the pouch end having a pouch end connector thereon;

(4) a cover unit partially bounding the opening, the cover unit being foldable over the opening to close the opening, (5) first fasteners situated at opposing regions of the pouch and the cover unit such that when the cover unit closes the opening, the first fasteners detachably affix the pouch and the cover unit to each other, c. a towel body:

(1) having a towel connection strap extending therefrom and within the reception space, the towel connection strap bearing a strap connector opposite the towel, wherein the strap connector is connected to the pouch end connector, (2) being sized such that it can be:

(a) fully received within the opening and the internal reception space with the cover unit closing the opening, and (b) extended from the pouch with at least a major portion of the towel body being outside of the opening and the internal reception space.

18. The towel of claim 17 wherein the pouch end connector is connected to the pouch end via an end connector strap, the end connector strap being affixed to the pouch end within the reception space.

19. The towel of claim 18 wherein the end connector strap defines a loop encircling a portion of the pouch end connector.

20. The towel of claim 17 wherein the pouch end connector is situated on the exterior of the pouch.

21. The towel of claim 20 wherein the pouch end has an aperture defined therein through which the towel connection strap extends.

22. The towel of claim 17 wherein the pouch is formed of:

a. a shielding surface defining an at least substantially continuous area of fabric between the pouch end and the opening; and b. a ventilating surface extending adjacent the shielding surface between the pouch end and the opening, the ventilating surface having air holes:

(1) extending between the exterior of the pouch and the reception space, and (2) defining at least half of the area of the ventilating surface.

23. The towel of claim 22 wherein:

a. both the shielding surface and the ventilating surface have opposing lateral sides extending between the pouch end and the opening, and b. the lateral sides of the shielding surface are joined to the lateral sides of the ventilating surface.

* * * * *